US005888324A

United States Patent [19]

Nakamura et al.

[11] Patent Number: 5,888,324

[45] Date of Patent: Mar. 30, 1999

[54] WIRING HARNESS A METHOD FOR PRODUCING A WIRING HARNESS AND A WIRING HARNESS PRODUCING APPARATUS

[75] Inventors: Atsushi Nakamura; Masashi Sato, both of Yokkaichi, Japan

[73] Assignee: Sumitomo Wiring Systems, Inc., Japan

[21] Appl. No.: 853,114

[22] Filed: May 8, 1997

[30] Foreign Application Priority Data

| | | | |
|---|---|---|---|
| May 9, 1996 | [JP] | Japan | 8-114747 |
| May 9, 1996 | [JP] | Japan | 8-114748 |
| May 9, 1996 | [JP] | Japan | 8-114749 |

[51] Int. Cl.[6] ..... H01B 7/00

[52] U.S. Cl. ..... 156/55; 29/755

[58] Field of Search ..... 156/55; 29/755

[56] References Cited

U.S. PATENT DOCUMENTS

| | | | |
|---|---|---|---|
| 3,911,201 | 10/1975 | Fry | 174/72 A |
| 4,154,977 | 5/1979 | Verma | 174/117 F |
| 4,880,943 | 11/1989 | Kuzuno et al. | 174/72 A |
| 5,010,642 | 4/1991 | Takahashi et al. | 29/868 |
| 5,230,146 | 7/1993 | Tsuji et al. | 29/861 |
| 5,518,570 | 5/1996 | Takagi et al. | 156/303 |

FOREIGN PATENT DOCUMENTS

| | | |
|---|---|---|
| 991016 | 9/1951 | France . |
| 63-128626 | 8/1988 | Japan . |
| 1-197916 | 8/1989 | Japan . |
| 1-177813 | 12/1989 | Japan . |
| 2-94211 | 4/1990 | Japan . |
| 2-278615 | 11/1990 | Japan . |
| 574612 | 1/1946 | United Kingdom . |

*Primary Examiner*—Francis J. Lorin
*Attorney, Agent, or Firm*—Anthony J. Casella; Gerald E. Hespos; Ludomir A. Budzyn

[57] ABSTRACT

Placing tables 28, film adhering tables 27 and connector mounting tables 24 are individually formed and rearranged so as to conform to a desired wiring path. A plurality of wires 11 are linearly placed in parallel with each other on each placing table 28, and a wire length adjusting tool 14 formed with steps 15 with a specified inclination is brought into contact with the wires 11 to push them down, thereby setting different loosened lengths for the respective wires 11. Films 12 are adhered to the linear portions of the wires 11 to hold the different loosened lengths unchanged.

10 Claims, 13 Drawing Sheets

WIRING HARNESS A METHOD FOR PRODUCING A WIRING HARNESS AND A WIRING HARNESS PRODUCING APPARATUS

BACKGROUND OF THE INVENTION

1. Field of the Invention.

The present invention relates to a wiring harness, a method for producing a wiring harness and a wiring harness producing apparatus. The wiring harness may be used in internal wiring of office automation (OA) equipment, a home electric appliance or an automotive vehicle.

2. Description of the Prior Art.

A known wiring harness for electrical connection in an OA equipment, a home electric appliance or an automotive vehicle has a plurality of wires 1 bundled as shown in FIG. 16 for connecting a CPU, a display device and a variety of switches. Jigs (not shown) for holding a connector 3 and the wires 1 are arranged on a flat plate in accordance with an actual arrangement of the wiring harness. The wires 1 are arranged in accordance with the jigs, and an adhesion tape 2 for protection is wound around the bundle of wires 1. The taped wire bundle then is covered with a casing to be held in a specified configuration, and the cased wire bundle is mounted to conform to a wiring path inside an OA equipment, a home electric appliance or an automotive vehicle. However, according to this prior art, it takes a large amount of time to wind the adhesive tape 2 after arranging the wire bundle, thereby lowering work efficiency.

In view of the problem of the above described prior art, there are frequently used flat cables having a multitude of conductors. One example is a flexible print cable (FPC) in which a pattern of conductive paths 4 is printed on a flexible base film 5 which is then overlaid with a cover film 6, as shown in FIGS. 17 and 18. However, in the case of a complicated wiring harness having curved conductive paths 4, an etching mask is applied for each pattern in a production process, and after the patterns are formed in a large base film Dk, a patterned portion is punched and cut off as shown in FIG. 18. Thus, large apparatuses such as an etching apparatus and a cutting apparatus are required. Further, the use of the large base film Dk necessitates a large work space, leading to a poor space efficiency.

FIG. 19 shows another known method which includes linearly arranging a plurality of strip-like conductors 1 in parallel with each other, laying films 5, 6 on the opposite sides of the conductors 1, and folding the thus obtained flat cable according to a wiring path. According to this method, the apparatuses required for the prior art of FIGS. 17 and 18 can be dispensed with. However, in the wiring harness obtained according to the prior art of FIG. 19, folded portions 7 may be damaged or a portion between the folded portions 7 may be deformed in such a three-dimensional manner to part from the remaining parts of the wiring harness due to the elastic restoration of the folded portions 7 as shown in FIG. 20. This presents a problem that the configuration of the wiring harness cannot stably conform to the wiring path.

The respective conductors 1 may accurately be arranged along the wiring path into a corresponding configuration and at specified intervals. However, this requires a large amount of time for aligning the configuration of the conductors 1, leading to a poor time efficiency. Further, since a large film corresponding to the wiring path is required, the problem of the prior art of FIGS. 17 and 18 is left unsolved.

It is also necessary to easily cope with a design change of a wiring harness while solving the above problems.

Particularly, in the case of the second prior art, the large apparatuses are forced to be changed to cope with a design change of a wiring harness, considerably increasing production cost.

An object of the present invention is to provide a wiring harness, a method for producing a wiring harness and a wiring harness producing apparatus having or allowing for a simple construction of the apparatus, which is capable of easily producing a wiring harness without folding or bending and easily coping with a design change.

SUMMARY OF THE INVENTION

According to the invention, there is provided a wiring harness, comprising at least one specified wire group made of a plurality of wires preferably covered with an insulating coating. The wires extend through at least one curved portion where they are arranged at specified intervals along substantially concentrical arcs and, substantially linearly, through at least one linear portion which is continuous with the curved portion. The wiring harness further includes at least one fixing means provided at least at the linear portion so as to fix the respective wires together outside the curved portion.

According to a preferred embodiment of the invention, the fixing means comprises a sheet member adhered at least to the linear portion.

Preferably the wiring harness further comprises at least one protection film which is separate from the fixing means, and in particular separate from the sheet member. The protection film may be adhered to the curved portion for fixing the wires there. Preferably the protection film has a shape similar to that of the curved portion.

According to the invention, there is further provided a method for producing a wiring harness comprising a first step of linearly arranging a plurality of wires substantially in parallel with each other. The method then includes a second step of setting different loosened lengths for the wires of the specified wire group by pressing a tool formed with steps having a specified inclination against the wires. Alternatively, the second step may include bringing a loosened length adjusting means into close contact with the respective wires, to compensate for length differences between adjacent arcs of the wires of the finished wiring harness. The method proceeds with a third step of fixing a plurality of wires, in particular by adhering a film or the sheet member over the plurality of wires, outside the loosened lengths thereof.

According to a preferred embodiment, the method comprises a fourth step of establishing the desired position or configuration of the curved and linear portions of the wiring harness and adhering the protection film to the curved portion.

Preferably, in the first step, the plurality of wires are arranged to extend over an opening which is provided in a predetermined or predeterminable position on a surface of a placing table. In the second step, the respective wires then may be pushed into the opening using the loosened length adjusting means.

According to the invention, there is further provided an apparatus for producing a wiring harness comprising wire feeding means for feeding a plurality of wires, and a placing table comprising at least one table module, for linearly placing the wires. The apparatus further includes a loosened length adjusting means provided with wire positioning means, comprising preferably steps or recesses. Alternatively, the apparatus may include wire positioning means, extending at an angle different from 0° or 180°, preferably approximately transversely or normal to the wires. The loosened length adjusting means or the wire positioning means function to set different loosened lengths of the respective wires when brought into pressing contact with the wires on or at the placing table, and preferably on the placing table module.

According to a preferred embodiment of the invention, steps or recesses have a specified inclination, which is defined in accordance with the desired setting of the different loosened lengths of the respective wires.

Preferably the apparatus further comprises wire aligning means for substantially parallelly aligning the plurality of wires fed from the wire feeding means.

Further preferably, at least one opening is formed in a predetermined or predeterminable position of a surface of the placing table, in particular in a placing table module or between two adjacent placing table modules. The loosened length adjusting means is movable through or into the opening to push the respective wires after being brought into contact with the respective wire positioning means, in particular into contact with steps or recesses thereof. The opening preferably has a width along the longitudinal direction of the wires such that the wires are smoothly bent when they are pushed by the respective wire positioning means.

Preferably, the placing table further comprises a sheet member adhering table module for adhering a sheet member to the linear portion of the plurality of wires after the setting of the different loosened lengths. The placing table may further comprise a protection film adhering table module for adhering a protection film to the curved portion of the plurality of wires.

The placing table may further comprise at least one connector connecting table module for connecting at least one connector with at least a part of the plurality of wires after the setting of the different loosened lengths thereof by the loosened length adjusting means.

According to still a further preferred embodiment, the portion of the loosened length adjusting means coming into contact with the wires and/or the edges of the placing table is/are rounded off.

Preferably, the height hn of the n-th step corresponding to the n-th wire of the plurality of wires is approximately given by the following formula:

$$h_n \approx \sqrt{\left(\frac{L_n}{2}\right)^2 - \left(\frac{a}{2}\right)^2} = \frac{1}{2}\sqrt{L_n^2 - a^2}$$

wherein Ln is the length of the bent portion of the n-th wire and a is the width of an opening of the placing table along the longitudinal direction of the wires. The length Ln preferably is given by the following approximative equation:

$$L_n \approx 2\pi n w \frac{\epsilon[°]}{360°}$$

wherein $\epsilon$ is the bending angle by which the wires are bent and w is the distance between adjacent wires. The equations for the height hn of the n-th step and/or for the length Ln of the n-th wire is/are preferably adopted for $n \geqq 4$. Thus the height hn can be determined within a predetermined level of accuracy.

Most preferably, the wire positioning means, and particularly the steps or recesses thereof, are spaced from each other. The spacing may be in the lateral direction of the loosened length adjusting means, depending upon or in correspondence with the spacing(s) of the wires.

According to a preferred embodiment of the invention, there is provided a wiring harness producing apparatus, comprising wire feeding means for feeding a plurality of wires. Wire aligning means is provided for aligning, substantially in parallel the plurality of wires fed from the wire feeding means. The apparatus further includes a placing table for substantially linearly placing the plurality of wires aligned in parallel with each other by the wire aligning means. Loosened length adjusting means may be provided with steps with a specified inclination which are pressed against the wires on the placing table to loosen the respective wires by different lengths. A film adhering table may be provided for linearly placing the plurality of wires aligned in parallel with each other by the wire aligning means and for adhering a film to the plurality of wires after the loosened lengths thereof are set by the loosened length adjusting means. The apparatus further includes a connector connecting table for linearly placing the plurality of wires aligned in parallel with each other by the wire aligning means and connecting a connector with the plurality of wires after the loosened lengths thereof are set by the loosened length adjusting means. The placing table, the film adhering table and the connector connecting table are individually detachable on the apparatus.

Accordingly, since the placing table, the film adhering table and the connector connecting table are individually detachable, the wiring harness producing apparatus can be changed in various manners by changing their combination. This leads to an enhanced degree of freedom in designing wiring harnesses.

Preferably, an opening is formed in a specified position of the upper surface of the placing table for allowing the tool or loosened length adjusting means to set the loosened lengths by being brought into contact with the wires and pushing them down. The plurality of wires are placed linearly in parallel with each other on the placing table to extend over the opening, and the loosened length adjusting means is brought into contact with the wires and pushed down in the opening to set the loosened lengths for the respective wires. Accordingly, the wires are allowed to have a curved portion corresponding to a desired wiring path by a very easy operation.

Thus, the opening for allowing the tool or loosened length adjusting means to set the loosened lengths by being brought into contact with the wires and pushing them down is formed in the specified position of the upper surface of the placing table. Accordingly, the plurality of wires are linearly placed in parallel with each other on the placing table to extend over the opening, and the loosened length adjusting means is brought into contact with the wires and pushed down in the opening to set the loosened lengths for the respective wires. Therefore, the wires are advantageously allowed to have a curved portion corresponding to a desired wiring path by a very easy operation.

According to a further preferred embodiment of the inventive method, a plurality of wires are linearly placed in parallel with each other on a placing table, and a tool formed with steps with a specified inclination is pressed against the wires to set different loosened lengths for the respective wires. In this way, a curved portion in conformity with a desired wiring path can easily be formed by the respective wires while space efficiency is improved by linearly arranging the wires.

Further, a film may be adhered to the plurality of wires having the loosened lengths thereof set in order to hold the different loosened lengths unchanged.

Thus there is provided a wiring harness producing method for the easy production of a wiring harness without partly folding the wiring harness along its wiring path. The method achieves a curved portion by using a producing apparatus of simple construction.

Preferably, an opening is formed in a specified position of the upper surface of the placing table. The plurality of wires are linearly placed in parallel with each other to extend over the opening, and the loosened lengths are set by bringing the tool into contact with the wires and pushing them down in the opening. Thus, a curved portion in conformity with a desired wiring path can be formed by the respective wires only by a very easy operation.

According to a further preferred embodiment of the invention, a wiring harness producing apparatus comprises wire feeding means for feeding a plurality of wires, wire aligning means for aligning in parallel the plurality of wires fed from the wire feeding means, a placing table for linearly placing the plurality of wires aligned in parallel with each other by the wire aligning means, and loosened length adjusting means formed with steps having a specified inclination for setting different loosened lengths for the respective wires by being brought into pressing contact with the wires on the placing table.

Preferably, an opening for allowing the tool or loosened length adjusting means to set the loosened lengths by being brought into contact with the wires and pushing them down is formed in a specified position of the upper surface of the placing table.

Further preferably, the wiring harness producing apparatus further comprises a film adhering table for adhering a film to the plurality of wires having been loosened by the different lengths. Thus the film can easily be adhered.

According to still a further preferred embodiment of the invention, there is provided a wiring harness, comprising a wire group made of a plurality of wires and having at least one curved portion where the wires are arranged at specified intervals while being substantially concentrically curved and at least one linear portion, continuous with the curved portion, where the wires are linearly arranged in parallel with each other on the same plane, and a sheet member adhered to the linear portion so as to fix the respective wires.

In this case, the curved portion may be formed by linearly placing the plurality of wires in parallel with each other on a specified placing table formed with an opening in a specified position of its upper surface and by bringing a tool formed with steps with a specified inclination into contact with the wires and pushing the wires down in the opening to set different loosened lengths corresponding to different radii of curvature for the respective wires. The film is or may be adhered at least to the linear portion after the loosened lengths of the respective wires at the curved portions are set in accordance with the different radii of curvature.

Accordingly, since the sheet members are or may be adhered to the linear portions and the wires are substantially concentrically curved at the curved portion, the radii of curvature different for the respective wires can easily be set only by pressing the specified tool against a plurality of wires when the wires are concentrically curved at the curved portion. Accordingly, a wiring harness in conformity with a desired wiring path can easily be formed by linearly arranging the wires for a space-saving purpose during the production.

The present invention may preferably also directed to the loosened length adjusting means or tool itself and not only as a part of the apparatus for producing a wiring harness.

These and other objects, features and advantages of the present invention will become more apparent upon a reading of the following detailed description and accompanying drawings.

DETAILED DESCRIPTION OF THE PREFERRED EMBODIMENTS

Figure 1:
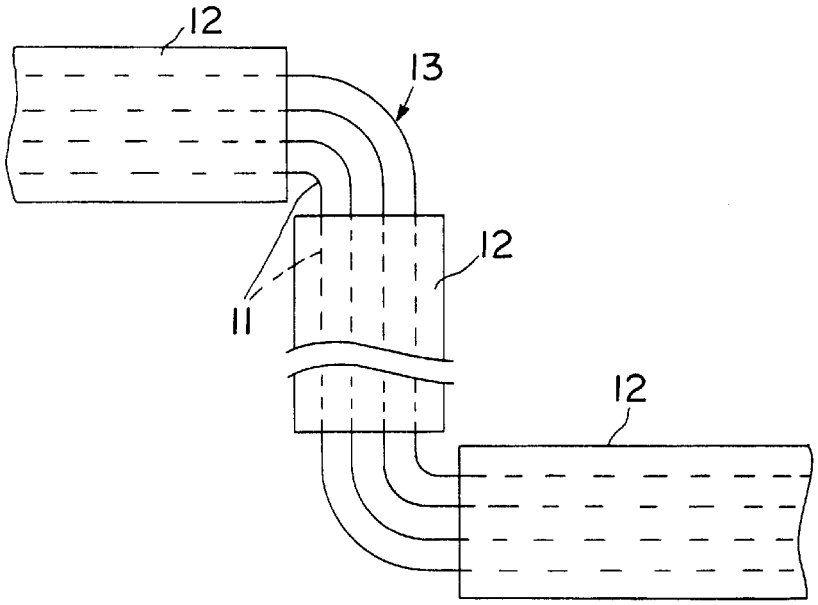
FIG. 1 is a plan view of a wiring harness produced by a producing apparatus according to one embodiment of the invention.

FIG. 1 is a diagram of a wiring harness according to one embodiment of the invention. In this wiring harness, a plurality of wires 11 are arranged substantially in parallel at substantially even intervals on the same plane, and are partly fixed by adhering films 12.

Films 12 may be used to fix the wires 11 and may be made of, e.g. polyvinyl chloride (PVC), polyethylene (PE) or a thin metal plate are adhered to parts of the wires from above using a cold adhesive or thermoplastic adhesive.

To conform to a complicated wiring path having curved portions, all wires 11 are curved along substantially concentric arcs at substantially even intervals in each curved portion 13. For a producing method to be described later, the films 12 may be adhered to linear portions 13*b* of the wires 11, but not to the curved portions 13*a* thereof. Therefore, the respective wires 11 used are of the type which are covered with insulating coatings made of polyvinyl chloride (PVC) or polyethylene (PE).

Depending on an environment where the wiring harness is used, the wiring harness may be required to be heat resistant. In such a case, a fluorocarbon resin (Trademark: "Teflon") may be used as a coating material of the wires 11; enamelled wires may be used as wires 11; polyimide (PI) or polyphenylene sulfide (PPS) as a product may be used as films 12 and the wires 11 and the films 12 may be fixed using a thermosetting adhesive.

As shown in FIG. 1, no film is adhered to the wires 11 in the curved portions 13. However other curvatures or bendings are possible. Therefore, the respective wires 11 used are of the type which are covered with insulating coatings. Although four wires 11 are arranged in this embodiment, the number of the wires 11 is not limited to four provided that the wires 11 are arranged in substantially parallel at preferably even intervals or spacings or pitches on the same plane, at least within predetermined tolerances. Also substantially uneven intervals of the wires 11 may be chosen, i.e. the wires 11 must not be equally spaced.

Figure 2:
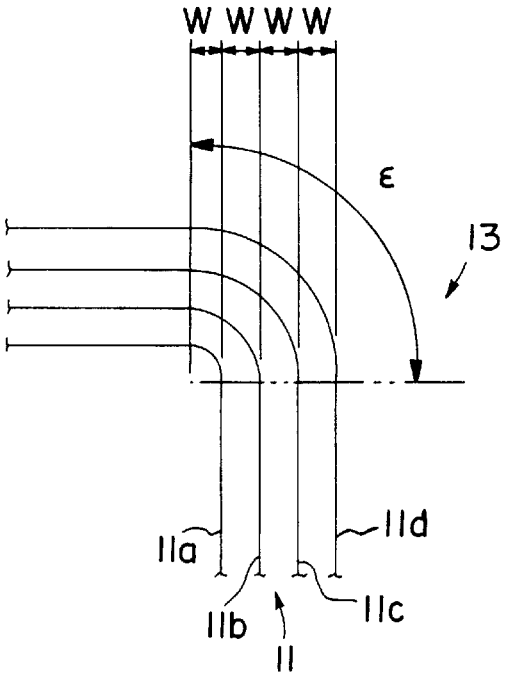
FIG. 2 is a diagram of a curved portion of the wiring harness of FIG. 1 in which the respective wires are bent at 90°.

FIG. 2 is a diagram showing the wires 11 the longitudinal direction thereof is curved by an angle of 90° in the curved portion 13. Since the wires 11 (11*a* to 11*d*) are spaced by a specified distance w in the curved portion 13 of the wiring harness, the lengths of the wires 11 need to be different or to have different lengths.

Assuming that a spacing between the wires 11*a* to 11*d* is w and the radii of curvature of the wires 11*a* to 11*d* are w, 2w, 3w, 4w, respectively, lengths L1, L2, L3, L4 of the wires 11*a* to 11*d* in the curved portion 13 are each a quarter of a circumference of a circle defined by the corresponding radius of curvature:

$$L1=(2\pi\cdot w)/4=\pi w/2$$

$$L2=(2\pi\cdot 2w)/4=\pi w$$

$$L3=(2\pi\cdot 3w)/4=3\pi w/2$$

$$L4=(2\pi\cdot 4w)/4=2\pi w.$$

Differences in length between the neighboring wires are:

$$L2-L1=(\pi w)-(\pi w/2)=\pi w/2$$

$$L3-L2=(3\pi w/2)-(\pi w)=\pi w/2$$

$$L4-L3=(2\pi w)-(3\pi w/2)=\pi w/2.$$

Figure 3:
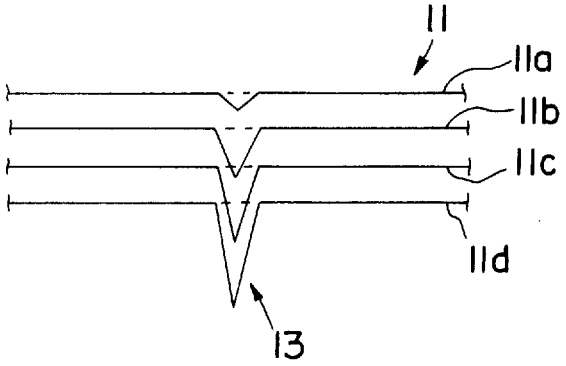
FIG. 3 is a diagram of the wires having the lengths thereof adjusted by a tool.

Thus, the differences in length between the neighboring wires need to be set at (πw/2). Although a method of manually arranging the wires 11 along the wiring path or aligning the wires 11 using a jig such as a mold may be adopted, such a method is poor in work efficiency and space efficiency. Accordingly, in this embodiment, the lengths of the wires 11 are differed in the following manner. After the wires 11 are linearly arranged substantially in parallel with each other as indicated in broken lines in FIG. 3, a wire length adjusting tool or means 14 (loosened length adjusting means, shown in FIG. 4) formed with bevelled portions or grooves or recesses or steps 15 of specified height ΔH at predetermined or predeterminable intervals (w) of the wires 11*a* to 11*d* is used to push or displace the wires 11*a* to 11*d* in a predetermined or predeterminable direction, e.g. down, to loosen them by specified lengths, thereby suitably adjusting the lengths of the wires 11*a* to 11*d* to form the curved portion 13 as indicated by solid lines in FIG. 3. The respective steps 15 of the wire length adjusting tool 14 are substantially in the form of an arcuate recess so as to prevent the wires 11*a* to 11*d* from getting out of the steps 15.

Figure 5:
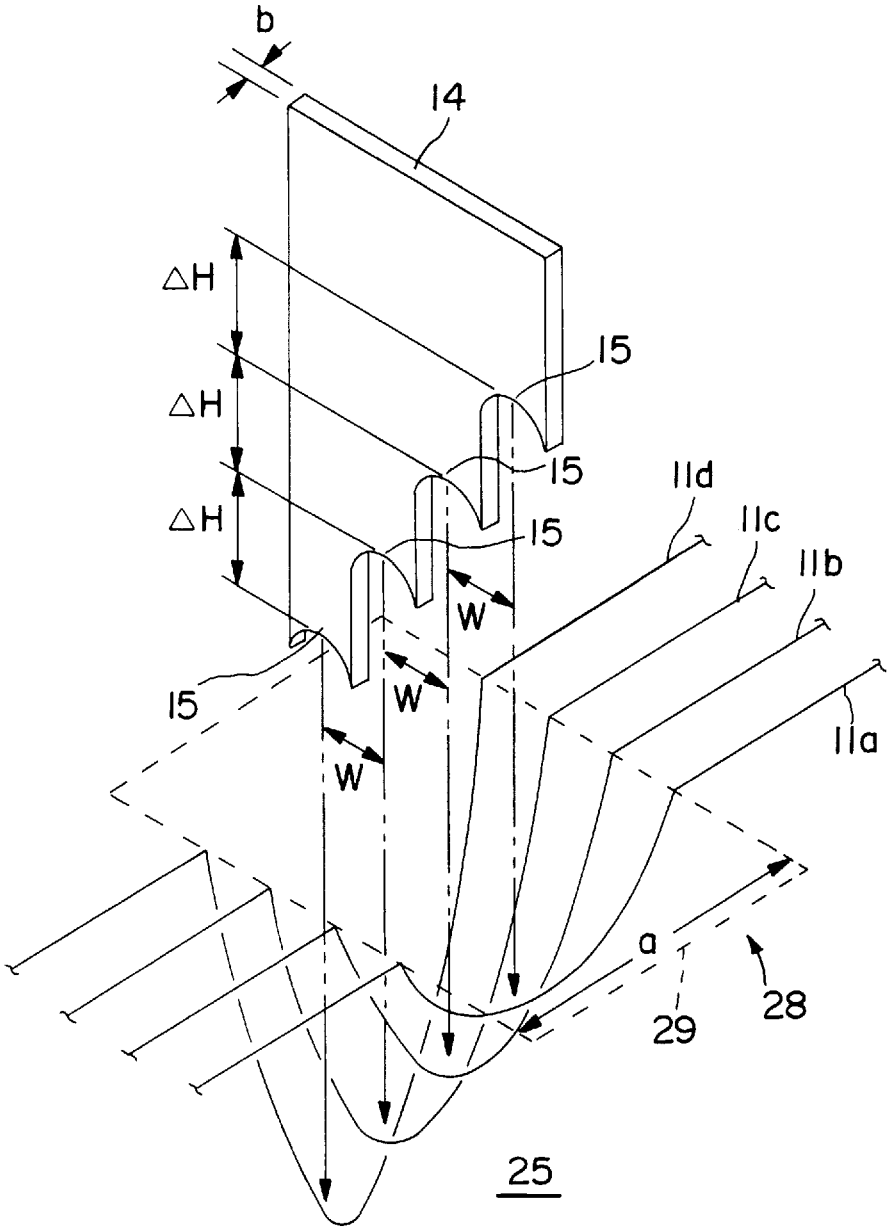
FIG. 5(A) is a perspective view showing an operation of adjusting the lengths of the wires at the curved portion using the tool of FIG. 3.
FIG. 5(B) is a schematic sectional view showing in an operation of the wire length adjusting tool pressing the wire into the opening.
FIG. 5(C) is a simplified sectional view showing a simplified scheme for determining the approximative heights of the steps of the loosened length adjusting means.
Figure 6:
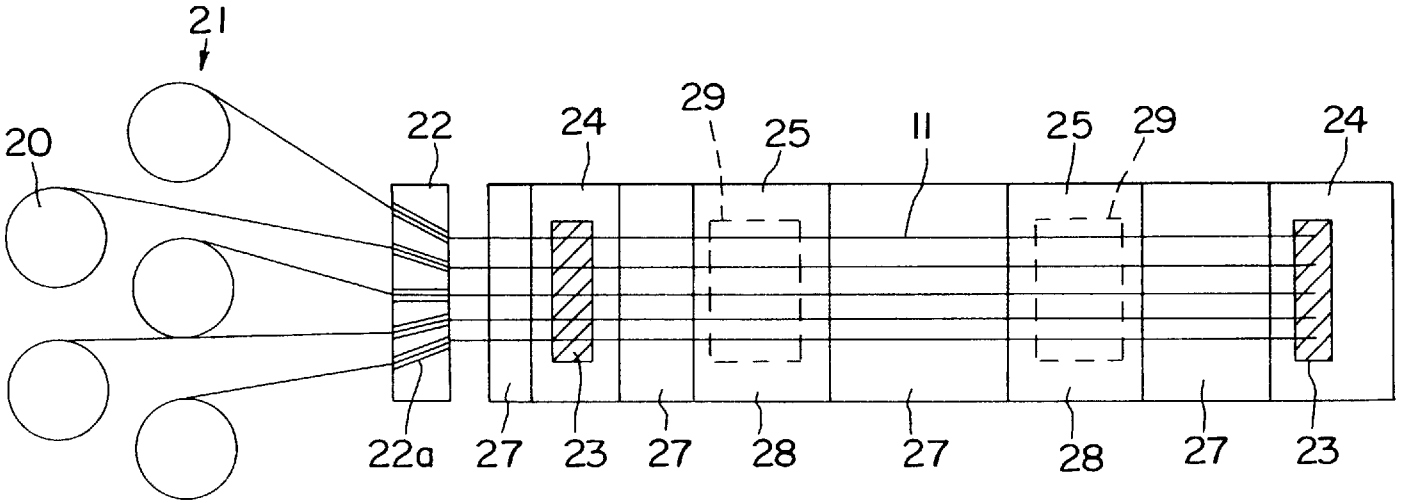
FIG. 6 is a plan view of the producing apparatus according to the embodiment.

A producing apparatus in accordance with the invention is shown in FIG. 6. This apparatus includes a wire feeder 21 (wire feeding means) having a plurality of wire feeding drums 20, of which five are shown as an example, to simultaneously feed the wires 11. A wire aligning unit 22 (wire aligning means) is formed with grooves 22*a* for aligning the spacing (w) of the plurality of fed wires 11. Connector connecting units 24 (connector connecting tables or placing table means), which may be of known type, are provided for connecting a specified connector 23 with the wires 11 and/or for placing the wires 11 in a predetermined or predeterminable arrangement. Circuit or wire length adjusting units 25 are provided for adjusting the length of the respective wires 11 (11*a* to 11*d*) forming circuits, preferably using the aforementioned wire length adjusting tool 14. Wire arrangement tables 27 (film adhering tables or wire portion fixing units) are provided for securing fixing means 12 to predetermined or predeterminable portions or positions of the wires 11. The wire arrangement tables 27 preferably are for adhering (or applying) films 12 or the like holding means to the wires 11 between the connector connecting unit 24 and the circuit length adjusting unit 25 and between the circuit length adjusting units 25. In each circuit length adjusting unit 25, an opening 29 for allowing the wires 11 to be pushed down by the wire length adjusting tool 14 to be loosened is formed in the middle of the upper surface of a placing table 28 as shown in FIG. 5. The wire aligning unit 22, the connector connecting units 24, the placing tables 28 of the circuit length adjusting units 25 and the wire arrangement tables 27 are set to have substantially the same height. These units are detachable as individual units so that their combination can easily be changed in accordance with a wiring path or may be unitarily or integrally formed.

The length Ln of the curved portion 13 of the n-th wire of the plurality of wires 11 corresponds to a height hn of the recess or step 15, by which the n-th wire is to be pressed into the opening 29, wherein the height hn is referred to a reference height 14*h* (FIG. 4) and the height of the n-th step ΔHn is given by the formula:

$$\Delta H_n=h_n-h_{n-1}$$

wherein the heights ΔHn are preferably all equal, if the wires 11 are to be arranged with a single bending or angle ϵ. In case the wires 11 shall be arranged with two or more different angles ϵ, ϵ', ϵ", etc. the heights ΔHn of the steps 15 are preferably groupwise equal (as e.g. in FIG. 14(A) to be described later).

Figure 5B:
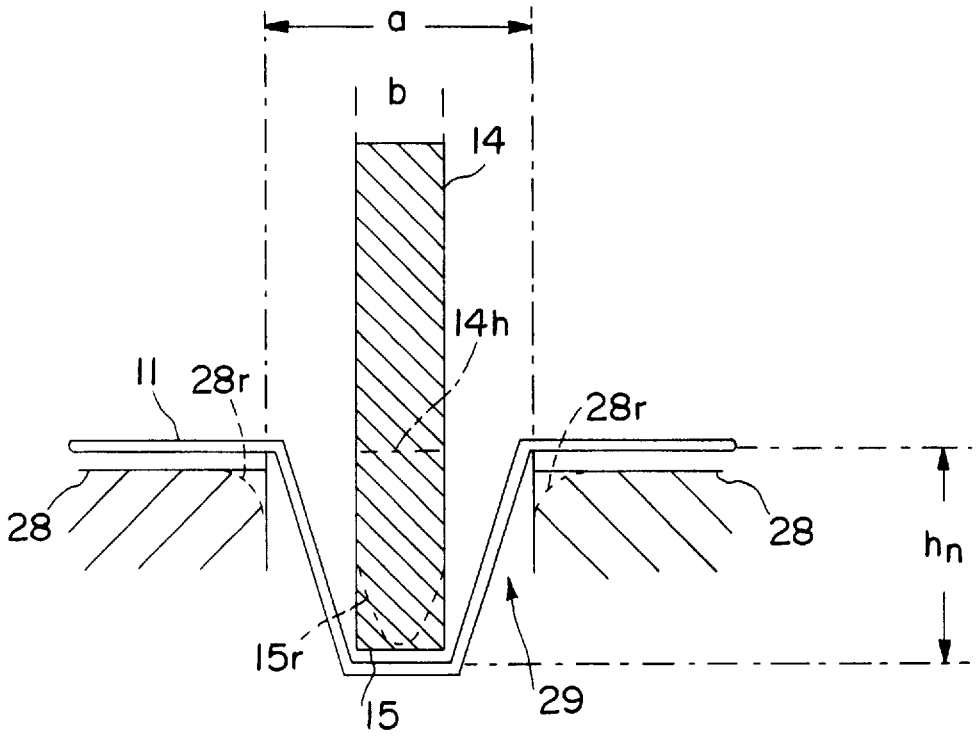
Figure 5C:
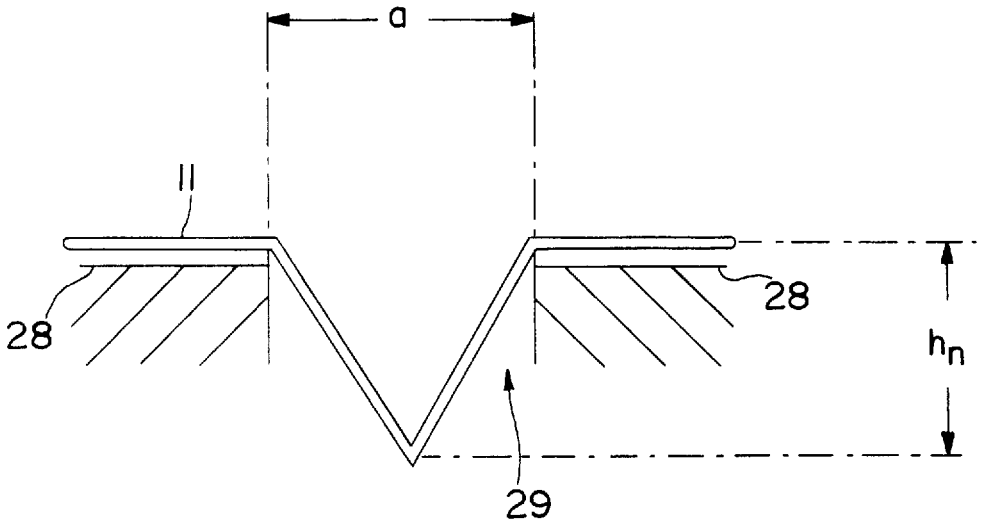

A relationship between the height hn of the n-th step 15 and the length Ln of the n-th wire of the plurality of wires 11 can be approximated, by assuming the geometrical dimensions as given in the schematic drawing of FIG. 5(C).

If b is the thickness of the wire length adjusting tool 14 in a longitudinal direction of the wires 11 and a is the width of the opening 29 in the same direction, then approximately:

$$L_n \approx b + 2\sqrt{\left(\frac{a-b}{2}\right)^2 + h_n^2}$$

Thus the height hn of the n-th step is approximately given by the following equation:

$$h_n \approx \sqrt{\left(\frac{L_n - b}{2}\right)^2 - \left(\frac{a-b}{2}\right)^2} = \frac{1}{2}\sqrt{L_n^2 - a^2 - 2b(L_n - a)}$$

The equation for the height hn can be even more simplified by assuming the arrangement of the wire 11 as shown in FIG. 5(C), i.e. by taking the limes for b→0:

$$h_n \approx \sqrt{\left(\frac{L_n}{2}\right)^2 - \left(\frac{a}{2}\right)^2} = \frac{1}{2}\sqrt{L_n^2 - a^2}$$

This equation may be adopted for n≧3, preferably for n≧4, since for smaller n the deviations could be too big and thus the precision of the wire arrangement could lie below a required error standard.

Preferably the tip or extremity 15*r* of the step or recess 15 may be rounded of as shown in FIG. 5(B) as phantom line for avoiding damages to the wires 11 and for reducing even more the deviations or errors, when calculating the height hn of the steps 15 by the above simplified formula or equation (FIG. 5(C)). Moreover the edges 28*r* of the placing table or units 28 may be rounded off (FIG. 5(B)) for avoiding damages to the wires 11 and allowing for a smooth bending thereof, when the length adjusting means 14 are inserted into the opening 29.

Furthermore the opening 29 should have such a width a, that the wires 11 are not damaged, when the wire length adjusting tool 14 is inserted thereinto, in particular for avoiding wedging or clipping of the wires 11 by the edges of the wire length adjusting tool 14 and/or damages caused by a too strong bending of the wires 11, when the gap or interstice or clearance between the edge of the placing table or connector connecting unit 24 and the loosened length adjusting means 14 is too small. In other words, the opening 29 has such a width a along the feeding direction P or longitudinal direction of the wires 11, that the wire length adjusting tool 14 can be loosely fitted or inserted into the opening 29 with the wires 11 arranged therebetween such that the wires 11 are not damaged, e.g. by wedging, buckling or too strong bending.

Figure 4:
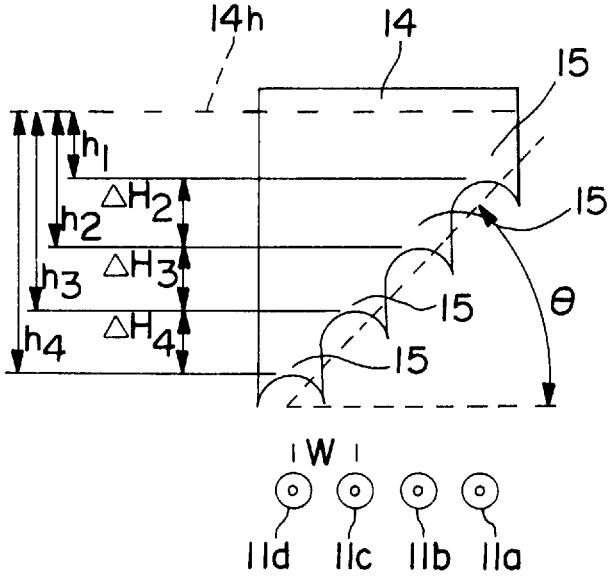
FIG. 4 is a front view of the tool used to produce the wiring harness of FIGS. 1 and 2.

Furthermore the steps or recesses or bevelled portions 15 may be spaced according to the distance or pitch of the wires 11. In FIGS. 4 and 5 the distance w between the wires 11 is equal for all the wires 11 and thus the corresponding steps 15 are equally spaced from each other. In case the wires are not equally spaced (not shown), the steps 15 are correspondingly also not equally spaced. In other words, the steps or recesses or bevelled portions 15 are formed in correspondence to the positions of the respective wires 11 to be displaced. Preferably the wire length adjusting tool 14 is produced or formed having an inclined side, into which recesses 15 are formed in accordance with the corresponding position of the wires 11 to be displaced.

Next, a method for producing a wiring harness using the aforementioned wire length adjusting tool 14 and producing apparatus is described.

First, the wires 11 are fed from the plurality of wire feeding drums 20 of the wire feeder 21, and are linearly placed in parallel with each other on the upper surfaces of the connector connecting units 24, of the placing tables 28 of the circuit length adjusting units 25, and of the wire arrangement tables 27 while being passed along the grooves 22*a* of the wire aligning unit 22 so as to space the wires 11 by a specified width w.

Subsequently, the steps 15 of the wire length adjusting tool 14 are brought into contact with the wires 11 (11*a* to 11*d*) extending in or over the opening 29 preferably in the middle of the placing table 28 as shown in FIG. 5, and pushed down by a specified distance to loosen the wires 11*a* to 11*d* by the distances corresponding to height hn of the respective steps 15. At this time, the wires 11 are fed from the respective wire feeding drums 20 by the loosened lengths. The wire length adjusting tool 14 may be automatically pushed down using an electrically or electronically controlled elevating device and/or manually pushed down by an operator.

Thereafter, the specified films or fixing means 12 are adhered to the wires 11 from above at the wire arrangement tables 27 to fix the wires 11, in particular in or at the linear portions of the wires 11, and the specified connectors 23 are connected with the wires 11 by the connector connecting units 24, thereby completing the wiring harness shown in FIG. 1.

Hard molded parts may be used instead of the aforementioned films 12. In such a case, if the molded parts are provided with a locking mechanism used to mount the wiring harness on an apparatus such as an OA equipment, a home electric appliance or an automotive vehicle, the wiring harness can easily be mounted in a later process.

Figure 7:
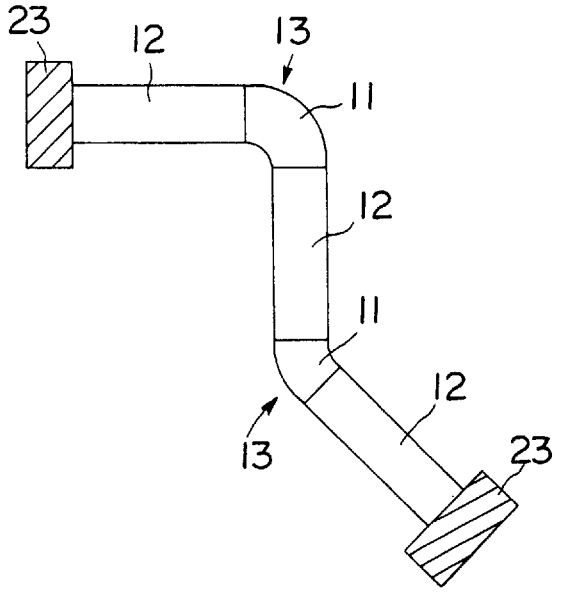
FIG. 7 is a plan view of a wiring harness produced by a producing apparatus according to another embodiment of the invention.
Figure 8:
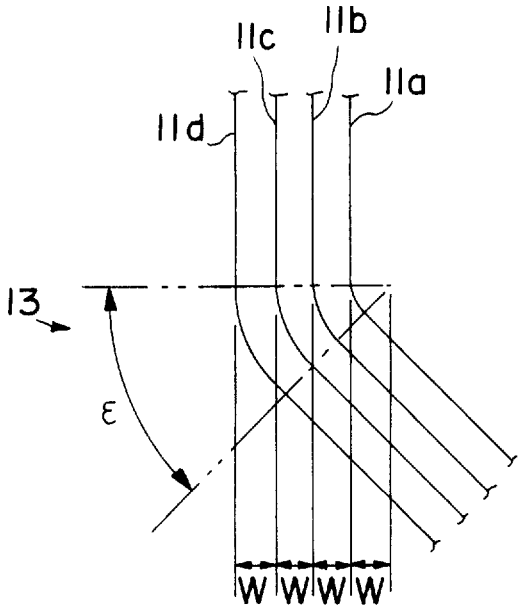
FIG. 8 is a diagram of a curved portion of the wiring harness of FIG. 7 in which the respective wires are bent at 45°.

In the case that the longitudinal direction of the wires 11 needs to be bent at an angle of, e.g. 45° in the curved portion 13 as shown in FIGS. 7 and 8, the height difference (ΔHn) between adjacent steps 15 of the wire length adjusting tool 14 may be so set as to conform to the difference ($L_n$–$L_{n-1}$) in length between the wires 11 as follows. If the spacing between the wires 11 is w and the radii of curvature of the wires 11 are w, 2w, 3w, 4w, respectively, lengths L1, L2, L3, L4 of the wires 11*a* to 11*d* in the curved portion 13 are each one eighth of a circumference of a circle defined by the corresponding radius of curvature:

$$L1=(2\pi w)/8=\pi w/4$$

$$L2=(2\pi\cdot 2w)/8=\pi w/2$$

$$L3=(2\pi\cdot 3w)/8=3\pi w/4$$

$$L4=(2\pi\cdot 4w)/8=\pi w.$$

Differences in length between the neighboring wires are:

$$L2-L1=(\pi w/2)-(\pi w/4)=\pi w/4$$

$$L3-L2=(3\pi w/4)-(\pi w/2)=\pi w/4$$

$$L4-L3=(\pi w)-(3\pi w/4)=\pi w/4.$$

Figure 9:
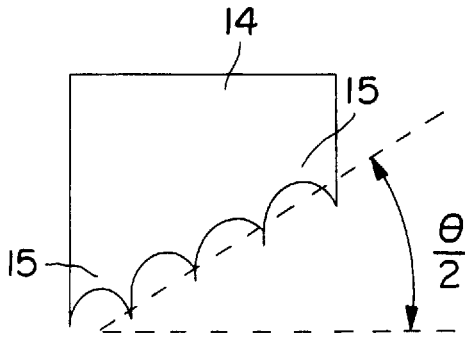
FIG. 9 is a front view of a tool used to produce the wiring harness of FIGS. 7 and 8.

Specifically, if the inclination of the steps 15 of the wire length adjusting tool 14 is θ (see FIG. 4) when a bending angle ϵ of the wires 11 at the curved portion 13 is 90°, the inclination of the steps of the wire length adjusting tool 14 is set to θ/2 as shown in FIG. 9 when the bending angle ϵ of the wires 11 is 45° as shown in FIG. 8. In general, the inclination of the steps 15 of the wire length adjusting tool 14 with respect to the bending angle ϵ of the wires 11 may be set at (θ×ϵ/90°).

In general the respective length of the n-th wire for a bending angle $\epsilon$ of the wires and for a distance between the wires 11 of w is given by the following equation (assuming that the wires are bent along an arc of a circumference):

$$L_n = 2\pi n w \frac{\epsilon[°]}{360°}$$

so that the length difference between adjacent wires generally is:

$$\Delta L = L_n - L_{n-1} = 2\pi w \frac{\epsilon[°]}{360°}$$

In case the bent portions 13 of the wires 11 do not follow an arc of a circumference the above equations apply only as an approximation, however the invention is not limited thereto. The inclination $\theta$ of the steps 15 may be constant for n sufficiently big, e.g. $n \geqq 4$.

As described above, only by performing a very easy action of pushing the wire length adjusting tool 14 having the steps 15 down with respect to the wires 11*a* to 11*d* after linearly arranging the wires 11*a* to 11*d*, the wires 11*a* to 11*d* can be adjusted in length by being loosened by the lengths suited to forming the curved portion 13. Accordingly, the wires 11*a* to 11*d* can be arranged within a short period of time without requiring a work space and without being folded as in the third prior art.

Figure 10:
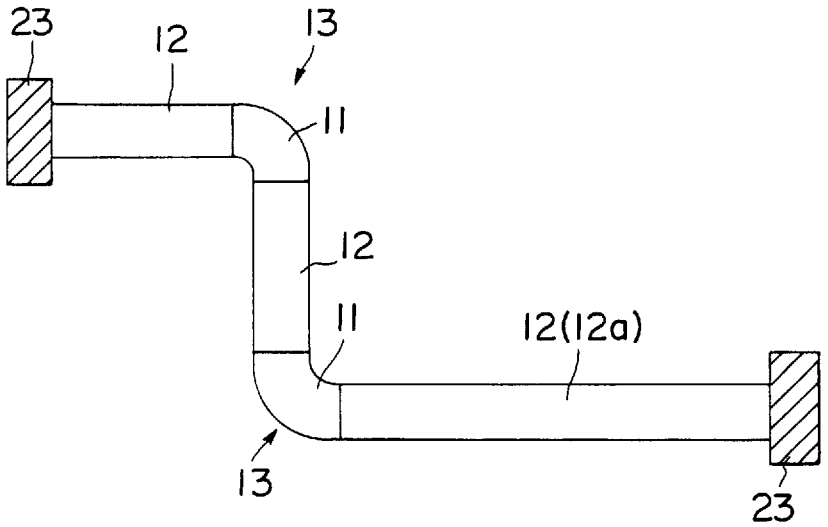
FIG. 10 is a plan view of a wiring harness produced by a producing apparatus according to a still another embodiment of the invention.
Figure 11:
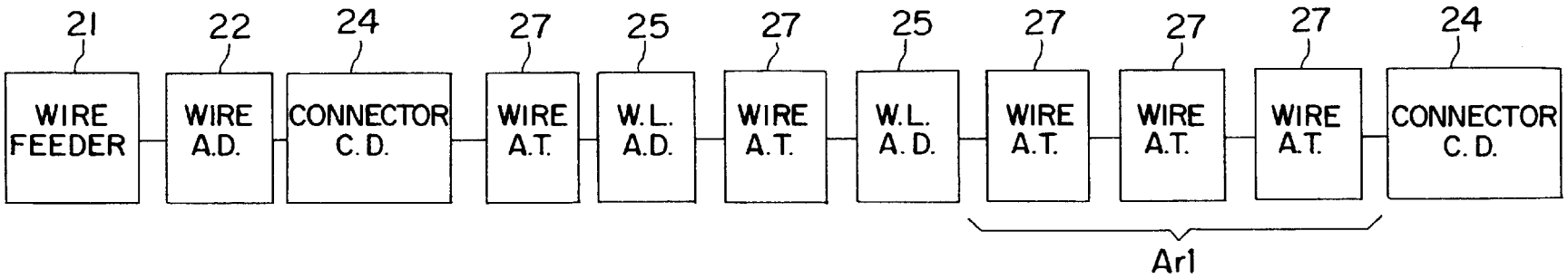
FIG. 11 is a plan view of the producing apparatus according to the still another embodiment of the invention.
Figure 12:
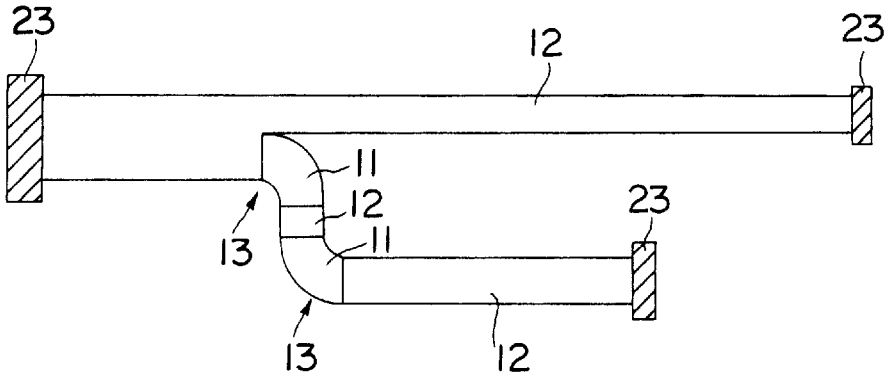
FIG. 12 a plan view of a wiring harness produced by a producing apparatus according to a further another embodiment of the invention.
Figure 13:
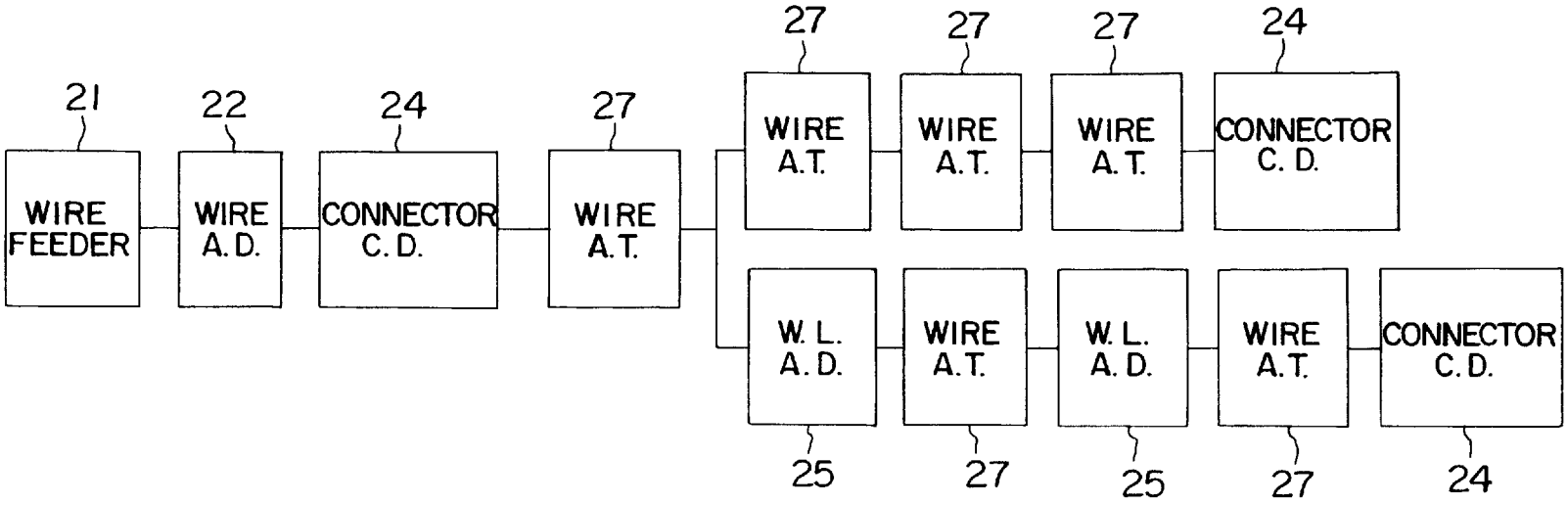
FIG. 13 is a plan view of the producing apparatus according to the further another embodiment of the invention.

Since the wire aligning unit 22, the connector connecting units 24, the placing tables 28 of the circuit length adjusting units 25, and the wire arrangement tables 27 are detachable as individual units, wiring harnesses corresponding to a variety of wiring paths can be fabricated by changing their combination in various manners. For example, if a part 12*a* of the wiring harness where the film 12 is adhered is wished to be elongated as shown in FIG. 10, a plurality of wire arrangement tables 27 may be juxtaposed as indicated by Ar1 in FIG. 11 or a differently specified wire arrangement table (not shown) having a different length may be set. Further, if some of the plurality of wires 11 are branched from the rest and only the branched wires 11 are curved (as shown in FIG. 12), the connector connecting units 24, the circuit length adjusting units 25, the wire arrangement tables 27, etc. may be so rearranged as to conform to a design of the wiring path as shown in FIG. 13. Since the respective units are detachable as individual units, a degree of freedom in designing wiring harnesses can be enhanced by changing the combination of the units in various manners.

In the case of a complicated wiring harness having three or more curved portions 13, the number of the circuit length adjusting units 25 may be increased so as to conform to the number of the curved portions 13. Further, if the distance between the curved portions 13 is changed in the case that there are a plurality of curved portions 13, the producing apparatus may be designed by changing, e.g. the distance between the connector connecting unit 24 and the circuit length adjusting unit 25.

Although the wires 11 having being loosened by specified lengths to form the curved portions 13 are arranged on the same plane in FIG. 1, they may be arranged while being curved in a three-dimensional manner.

Figure 14A:
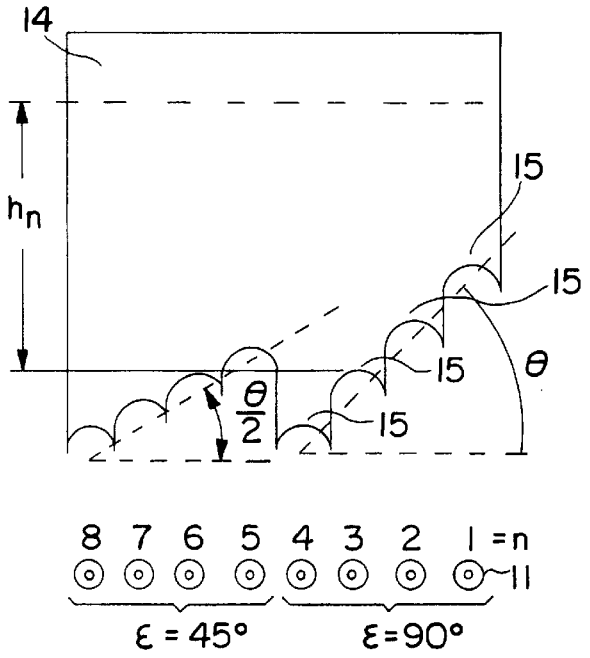
FIG. 14(A) is a front view of a tool used to produce the wiring harness of FIG. 14(B).
Figure 14B:
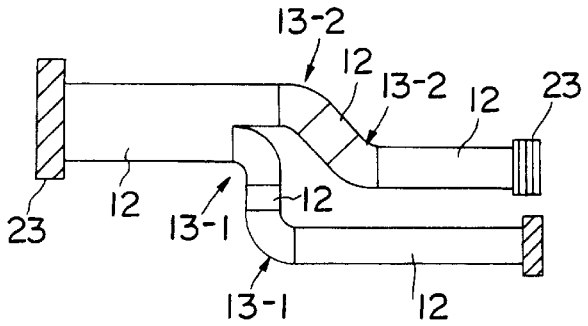
FIG. 14(B) a plan view of a wiring harness having differently bent portions, which is produced by a producing apparatus according to a further another embodiment of the invention.

Next a further preferred embodiment will be described with reference to FIG. 14. As can be seen from FIG. 14(B) the wire harness may have several branches being differently oriented e.g. by having different bent portions 13-1 and 13-2 having different angles (90° for the lower branch of FIG. 14(B) and 45° for the upper branch in FIG. 14(B)). These different bent portions 13-1 and 13-2 may be obtained by using the wire length adjusting tool 14 of FIG. 14(A). In this wire length adjusting tool 14 the steps or recesses 15 corresponding to the wires 11 (n=1..4) have an inclination of $\theta$ (yielding an angle $\theta$=90°), while the steps 15 corresponding to the wires 11 (n=5..8) have an inclination of $\theta/2$ (yielding an angle $\epsilon$=45°). The lengths of the wires n=1..4 are Ln=$\pi$ n w/2 and for n=5..8 Ln=$\pi$ n n w/4. Thus the heights h3 and h6 of the steps corresponding to the wires n=3 and n=6, respectively are the same.

Figure 15:
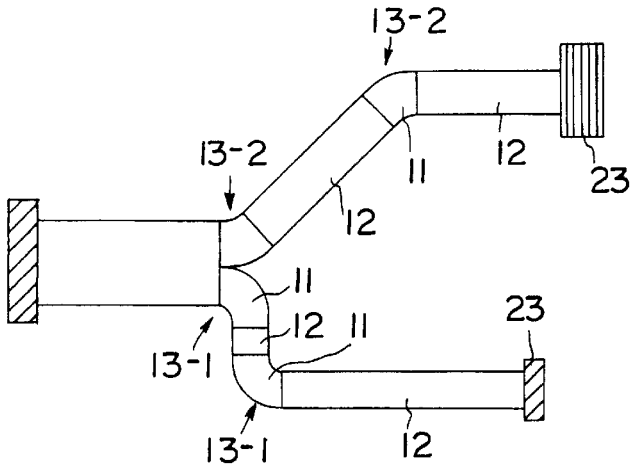
FIG. 15 a plan view of a wiring harness having differently bent portions, which is produced by a producing apparatus according to still a further another embodiment of the invention.
Figure 16:
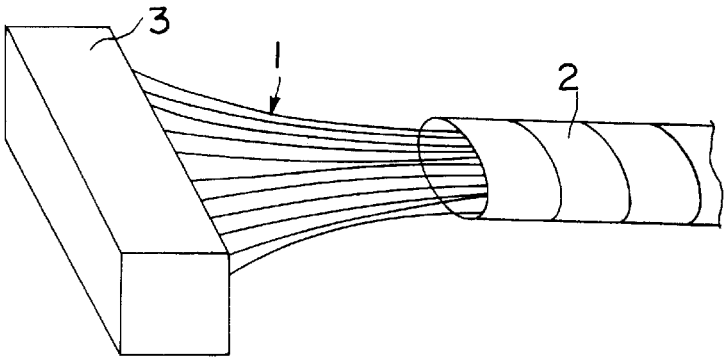
FIG. 16 PRIOR ART
FIG. 16 is a perspective view of a wiring harness for electrical connection according to first prior art.
Figure 17:
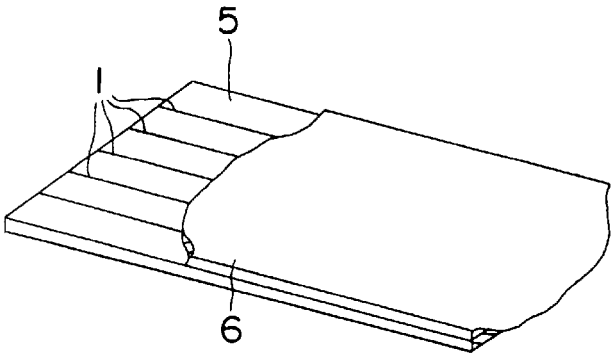
FIG. 17 PRIOR ART
FIG. 17 is a perspective view partly in section of a wiring harness for electrical connection according to second prior art.
Figure 18:
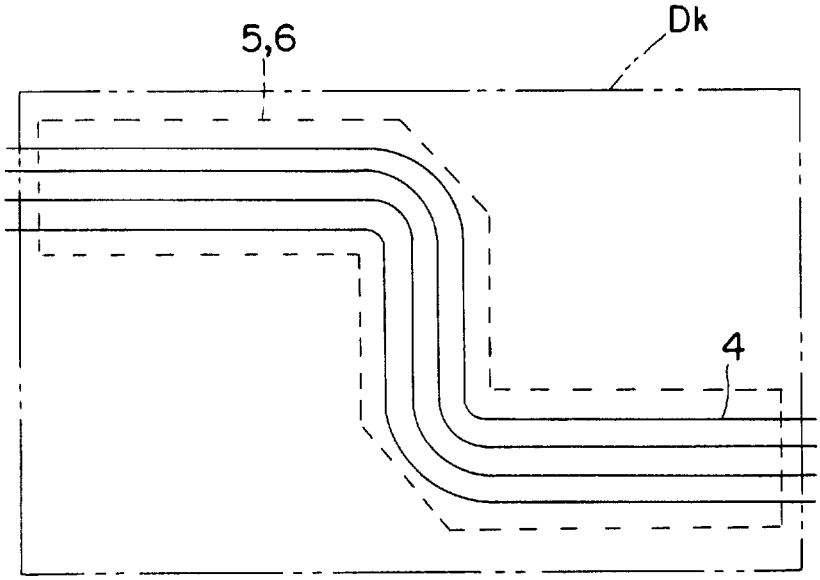
FIG. 18 PRIOR ART
FIG. 18 is a plan view showing a production process of the wiring harness according to the second prior art.
Figure 19:
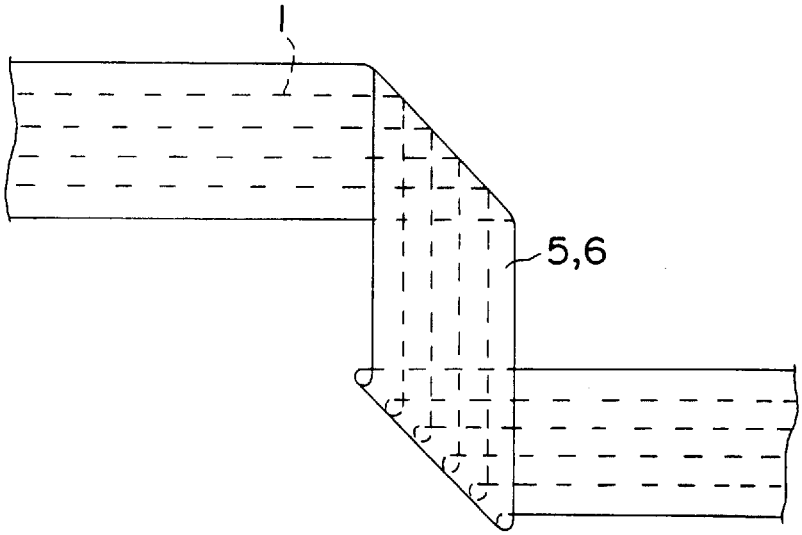
FIG. 19 PRIOR ART
FIG. 19 is a diagram of a folded wiring harness according to third prior art.
Figure 20:
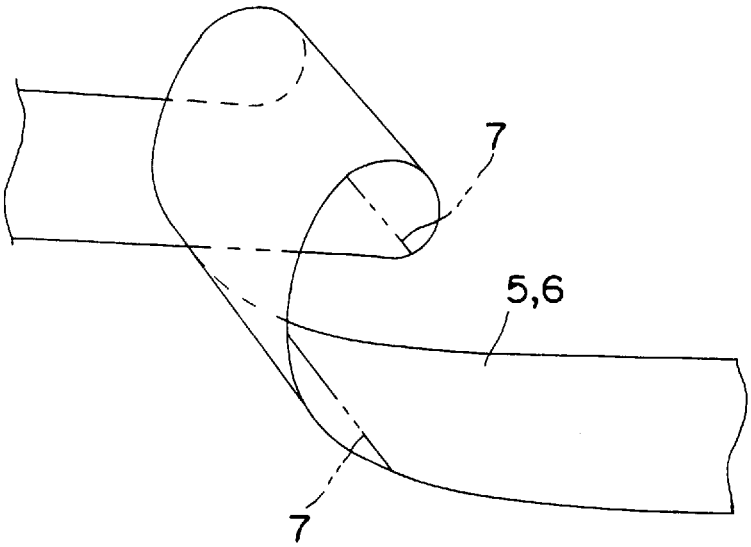
FIG. 20 PRIOR ART
FIG. 20 is a diagram showing the wiring harness of FIG. 19 in which folded portions are elastically restored.

As shown in FIG. 15 the wire harness may comprise also bent portions 13-1 and 13-2 having bendings in opposite directions, e.g. bent portion 13-1 being bent downward in FIG. 15 and bent portion 13-2 being bent upward in FIG. 15, wherein the angles $\epsilon$1 and $\epsilon$-2 of the bent portions 13-1 and 13-2, respectively may be equal or not ($\epsilon$-1=90° and $\epsilon$-2=45° in the depicted embodiment).

According to a further preferred embodiment (not shown) the wire length adjusting tool 14 may be arranged at an angle substantially different from 90° with respect to the longitudinal direction of the wires 11, so that the loosened portions of the wires 11 are not arranged on a line transverse to the direction, but shifted or spaced from each other with respect to the longitudinal direction of the wires. This embodiment allows for bent portions 13 of the wires 11 having different starting points, i.e. the bent portions 13 begin at longitudinally shifted positions with respect to each other, by using one single wire length adjusting tool 14. However, in case the bent portions 13 should start at equal positions the wire length adjusting tool 14 may be arranged substantially transverse (i.e. at 90°) with respect to the longitudinal direction of the wires 11 (or of the wire portions to be bent).

After the production of the wiring harness is completed to the state of FIG. 1, substantially arcuate films (not shown) may be adhered to the curved portions 13*a*.

What is claimed is:

1. An apparatus for producing a wiring harness comprising:

a wire feeder for feeding a plurality of wires a placing table comprising at least one table module for linearly placing the plurality of wires, and a wire length adjusting tool provided with a plurality of steps having widths selected in accordance with spacings of the wires, said steps being offset from one another by selected distances, said tool being movable toward said wires at an angle different from 0° and 180° such that said steps sequentially contact the respective wires to set different loosened lengths of the respective wires when the steps are brought into pressing contact with the wires at the placing table.

2. An apparatus according to claim 1, wherein the offset between the steps are selected to define a specified inclination angle which is defined in accordance with the desired setting of the different loosened lengths of the respective wires.

3. An apparatus according to claim 1, further comprising wire aligning means for aligning the plurality of wires fed from the wire feeding means substantially parallel to one another.

4. An apparatus according to claim 1, wherein at least one opening is formed in a predetermined position on a surface of the placing table into which the length adjusting tool is movable to push the respective wires after being brought into contact with the respective steps wherein the opening has a width along the longitudinal direction of the wires such that the wires are smoothly bent when they are pushed by the respective steps.

5. An apparatus according to claim 4, wherein the placing table means further comprises a sheet member adhering table module for adhering a sheet member to the linear portion of the plurality of wires after the setting of the different loosened lengths and a protection film adhering table module for adhering a protection film to the curved portion of the plurality of wires.

6. An apparatus according to claim 1, wherein the placing table further comprises:

at least one connector connecting table module for connecting at least one connector with at least a part of the plurality of wires after the setting of the different loosened lengths thereof by the length adjusting tool.

7. An apparatus according to claim 1, wherein a portion of the length adjusting tool coming into contact with the wires and the edges of the placing table are rounded off.

8. An apparatus according to claim 1, wherein a height hn of an n-th step corresponding to the n-th wire of the plurality of wires is approximately given by the formula:

$$h_n \approx \sqrt{\left(\frac{L_n}{2}\right)^2 - \left(\frac{a}{2}\right)^2} = \frac{1}{2}\sqrt{L_n^2 - a^2}$$

wherein Ln is the length of the bent portion of the n-th wire and a is the width of an opening of the placing table along the longitudinal direction of the wires, wherein the length Ln is given by the equation:

$$L_n = 2\pi n w \frac{\epsilon[°]}{360°}$$

wherein $\epsilon$ is the bending angle by which the wires are bent and w is the distance between adjacent wires.

9. An apparatus according to claim 8, wherein the equations for the height hn of the n-th step and for the length Ln of the n-th wire are adopted for $n \geqq 4$.

10. An apparatus according to claim 1, wherein the steps define arcuate recesses.

* * * * *